US007788769B2

(12) United States Patent
Wicker et al.

(10) Patent No.: US 7,788,769 B2
(45) **Date of Patent: *Sep. 7, 2010**

(54) CARRIER STRIP FOR HOLDING DRAPERY CARRIERS AND METHOD OF USE

(76) Inventors: Joe D. Wicker, 2750 N. Star Dr., Bartlett, TN (US) 38134-4712; Yu-Ting Kao, No. 4 Lane 256 Zhongzheng Road, Tainan County, Yong Kang City (TW) 710

( * ) Notice: Subject to any disclaimer, the term of this patent is extended or adjusted under 35 U.S.C. 154(b) by 0 days.

This patent is subject to a terminal disclaimer.

(21) Appl. No.: 12/478,755

(22) Filed: Jun. 4, 2009

(65) Prior Publication Data

US 2009/0255086 A1 Oct. 15, 2009

Related U.S. Application Data

(63) Continuation-in-part of application No. 11/601,557, filed on Nov. 17, 2006, now Pat. No. 7,757,347.

(60) Provisional application No. 60/597,260, filed on Nov. 18, 2005.

(51) Int. Cl.
*B61D 19/00* (2006.01)
*E05D 15/26* (2006.01)

(52) U.S. Cl. ..... 16/87 R; 16/87.2; 16/87.4 R; 16/87.6 R; 16/87.8; 29/433; 206/326; 160/345; 160/346; 160/347

(58) Field of Classification Search ..... 16/87 R, 16/87.2, 87.4 R, 97.6 R, 87.8; 160/330, 346, 160/368.1, 347, 345; 206/820, 326; 29/433
See application file for complete search history.

(56) References Cited

U.S. PATENT DOCUMENTS

| | | | |
|---|---|---|---|
| 2,966,695 | A | 1/1961 | Dwyer |
| 3,076,222 | A | 2/1963 | Sloan |
| 3,396,834 | A | 8/1968 | Luckey et al. |
| 3,913,204 | A | 10/1975 | Finkbeiner |
| 3,958,691 | A | 5/1976 | Schaeffer |
| 4,049,308 | A | 9/1977 | Martin |
| 4,229,857 | A | 10/1980 | Toder |

(Continued)

FOREIGN PATENT DOCUMENTS

| | | |
|---|---|---|
| TW | 093201271 | 12/2004 |

*Primary Examiner*—Victor Batson
*Assistant Examiner*—Jeffrey O'Brien
(74) *Attorney, Agent, or Firm*—Walker, McKenzie & Walker, P.C.

(57) ABSTRACT

A drapery carrier comprising a carrier body with first and second coaxially joined wheels on opposite sides of the carrier body, and bearings entrapped within the drapery carrier between raceway seat portions of the wheels. An axial finger extends from the first wheel and is engagingly held within an axial bore of the second wheel. Respective outer circumferential wheel surfaces of the first and second wheels define first and second wheel outer diameters of the first and second wheels, and the bearing center-to-center orbit diameter is less than the first and second wheel outer diameters. Three embodiments of a carrier strip hold a plurality of the drapery carriers prior to and during insertion within a drapery track, and permit easy insertion of the drapery carriers into the track by sliding the track onto the drapery carriers while they are held by the carrier strip.

3 Claims, 4 Drawing Sheets

U.S. PATENT DOCUMENTS 4,282,630 A 8/1981 Toder
4,684,022 A * 8/1987 Potucek ..... 206/347
5,542,149 A 8/1996 Yu
5,749,661 A 5/1998 Moller
5,829,587 A * 11/1998 Saiki et al. ..... 206/327
5,975,187 A * 11/1999 Chou ..... 160/345
6,189,182 B1 2/2001 Ko
7,108,130 B2 * 9/2006 Herelier et al. ..... 206/338

* cited by examiner

FIG. 1 (Prior Art)
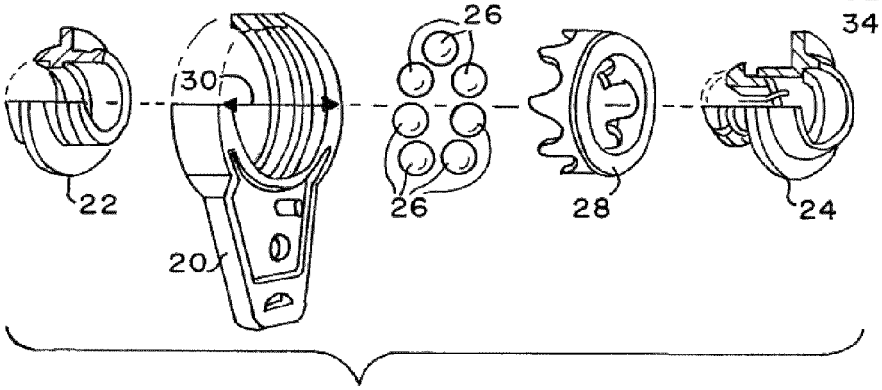
(Prior Art)
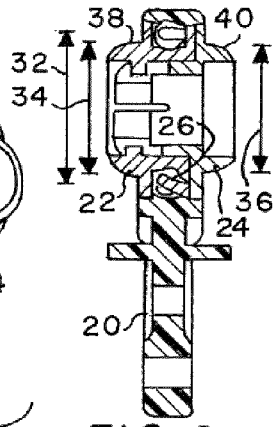
FIG. 2
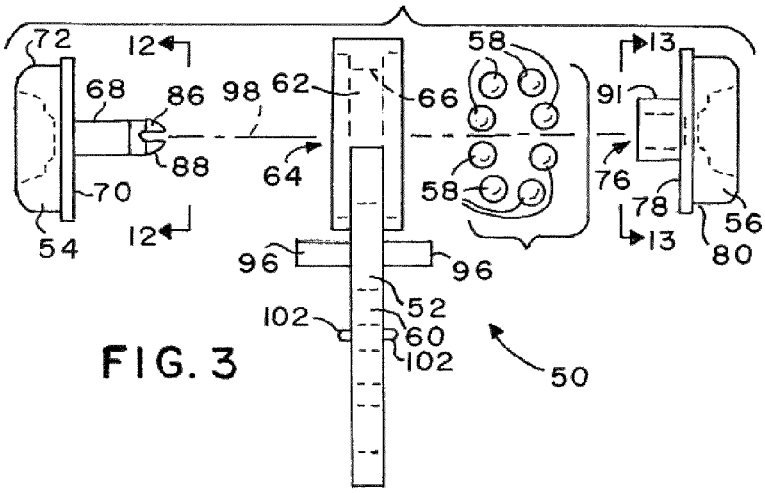
FIG. 3
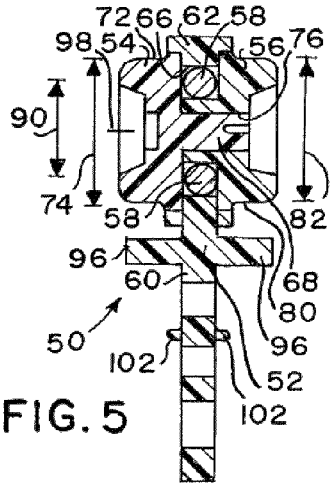
FIG. 5
FIG. 4
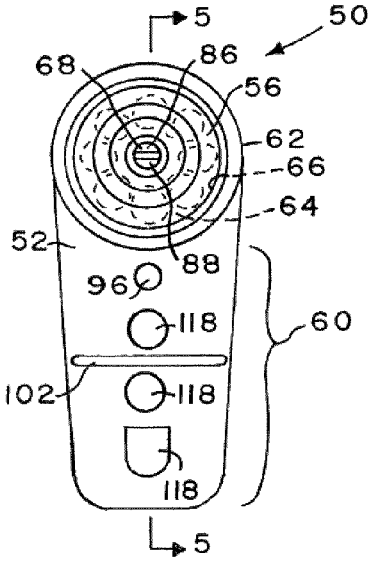
FIG. 6
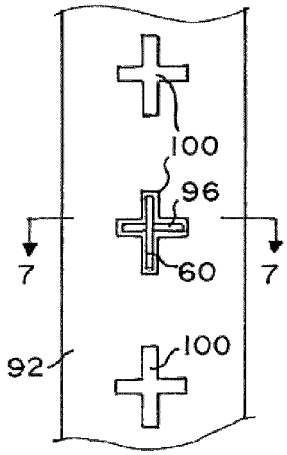
FIG. 7
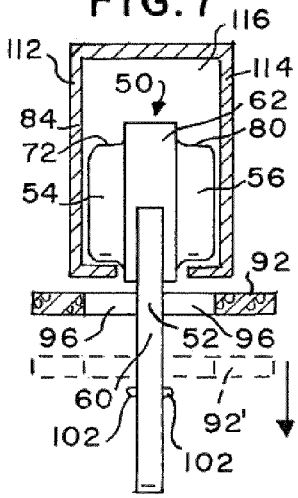

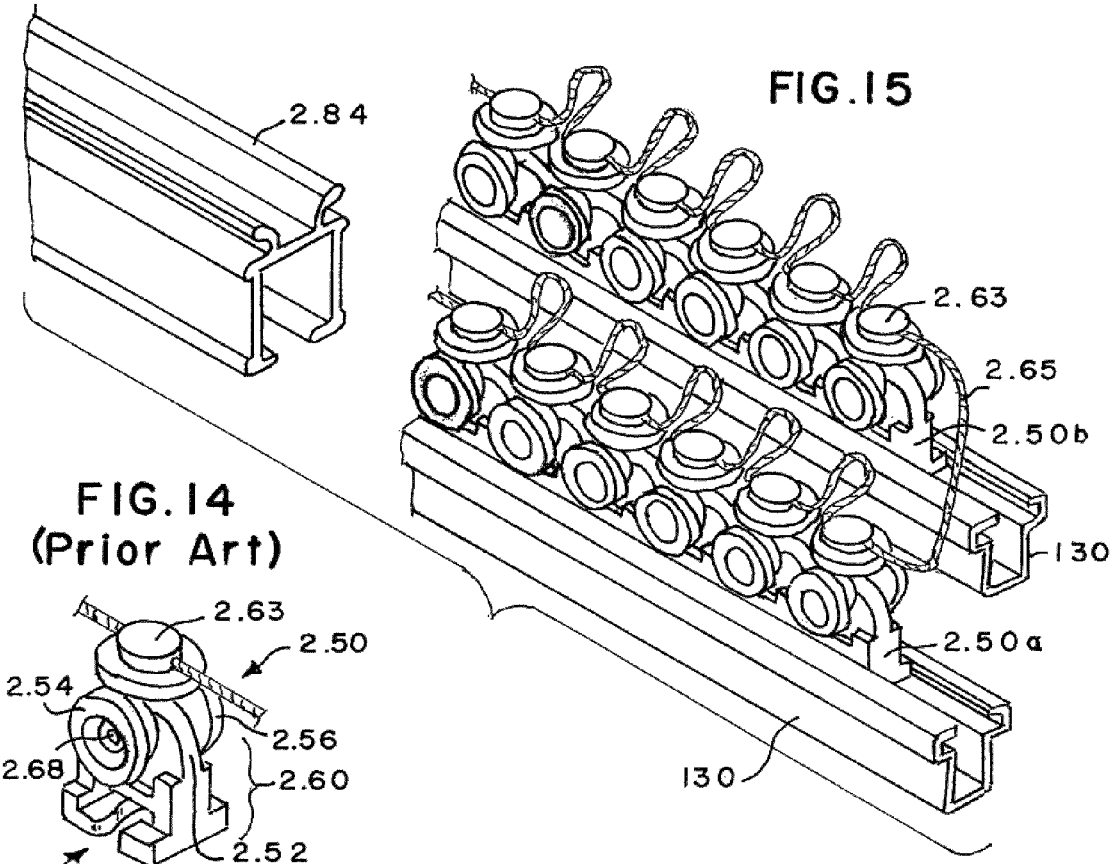
FIG. 15
FIG. 14
(Prior Art)
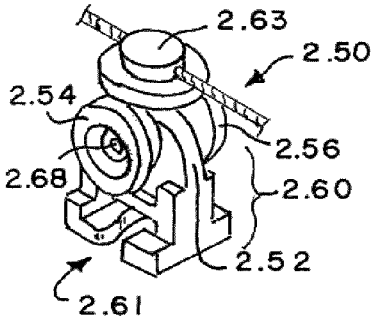
FIG. 16
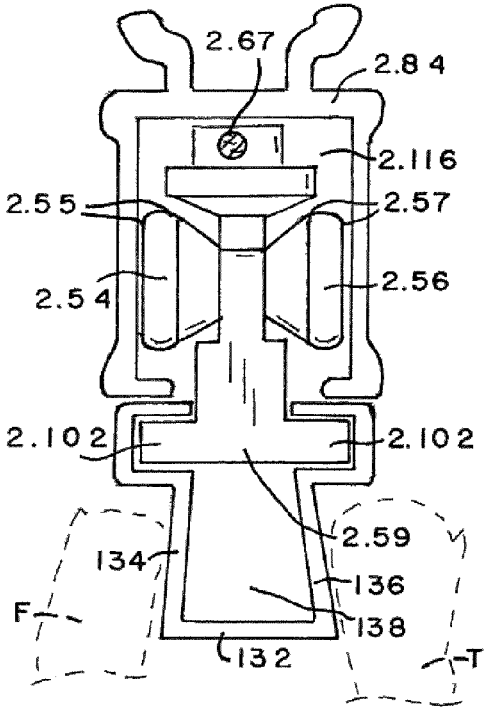
FIG. 17
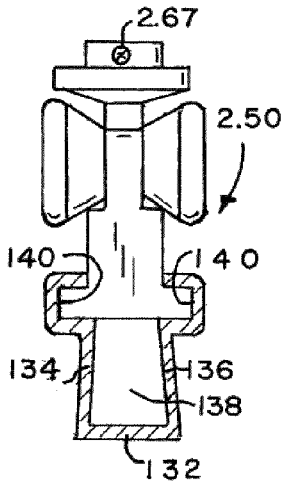
FIG. 18
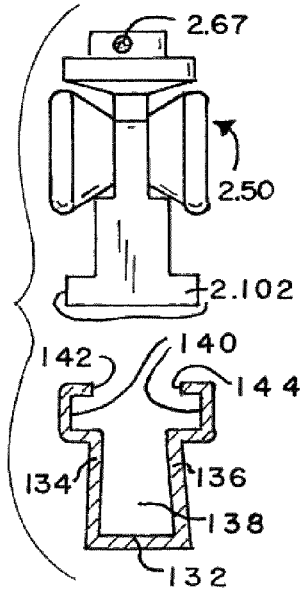

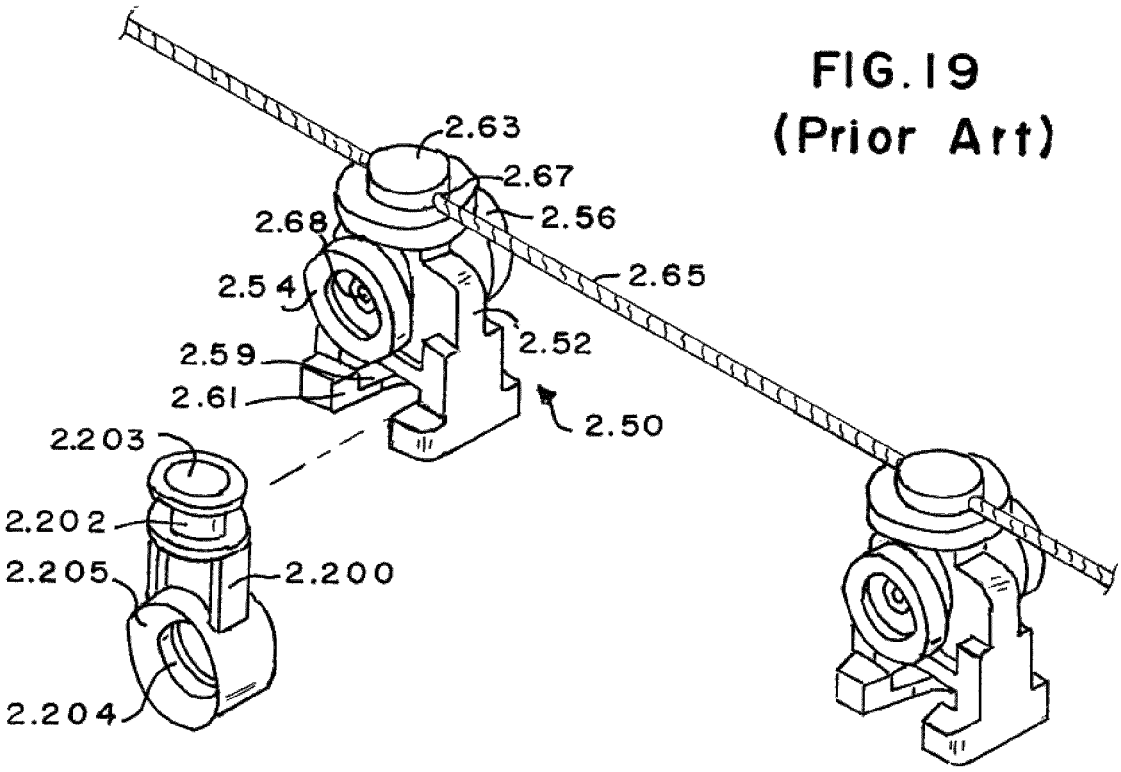
FIG. 19
(Prior Art)
FIG. 20
(Prior Art)
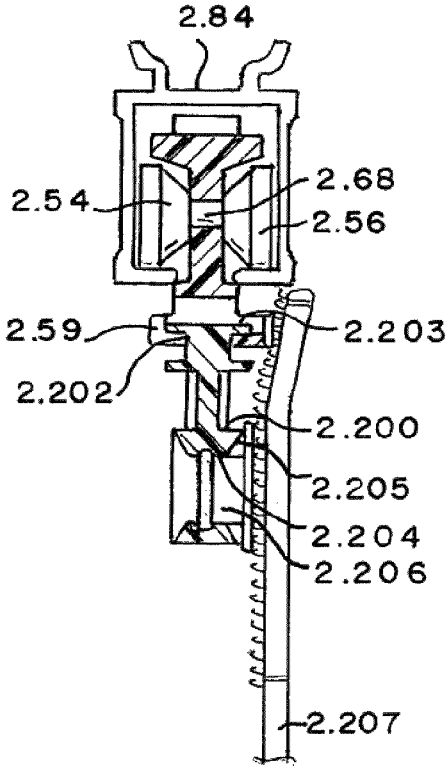

CARRIER STRIP FOR HOLDING DRAPERY CARRIERS AND METHOD OF USE

CROSS REFERENCE TO RELATED APPLICATIONS

This application is continuation-in-part of pending U.S. application Ser. No. 11/601,557, filed Nov. 17, 2006, which, in turn, was a non-provisional application corresponding to and claiming priority of U.S. Provisional Patent Application No. 60/597,260, filed Nov. 18, 2005, fully included by reference herein.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to drapery hangers supported on a track, and in particular, to an improved carrier strip for holding drapery carriers prior to and during insertion into a drapery track.

2. Information Disclosure Statement

Wheeled drapery carriers and drapery carriers having bearings are well-known for hanging a drapery on a track. Well-known solutions for this problem include those shown in Sloan, U.S. Pat. No. 3,076,222 (issued Feb. 5, 1963); Toder, U.S. Pat. No. 4,229,857 (issued Oct. 28, 1980); and Ko, U.S. Pat. No. 6,189,182 (issued Feb. 20, 2001). The prior art also discloses bearing cages and races such as those shown in Martin, U.S. Pat. No. 4,049,308 (issued Sep. 20, 1977); and Moller, U.S. Pat. No. 5,749,661 (issued May 12, 1998).

The drapery carrier disclosed in Ko, U.S. Pat. No. 6,189,182, is representative of prior art drapery carriers, and excerpts from the drawings of the Ko patent are shown in FIGS. 1 and 2 of this specification. As disclosed in the Ko patent and as shown in FIGS. 1 and 2 of this specification, a pulling plate or carrier body 20 is mounted with a first wheel seat 22 and a second wheel seat 24 about which a plurality of ball bearings 26 move in orbit about the wheel axis, entrapped by a confining cap 28. Typical of all prior art drapery carriers, the orbit diameter at which ball bearings 26 orbit within the carrier body of prior art drapery carriers is relatively large, causing prior art drapery carriers to have an undesirably large side-to-side dimension 30, thereby increasing the center-to-center stacking distance of adjacent drapery carriers on a track. In particular, it should be noted that the prior art bearing center-to-center orbit diameter 32, at which the bearings 26 orbit about the common axis of wheels 22, 24, is greater than the first and second outer diameters 34 and 36 defined by the side circumferential wheel surfaces 38 and 40 of first and second wheels 22 and 24, with bearings 26 being substantially outside of the first and second outer diameters 34 and 36. It is therefore desirable to have an improved drapery carrier that permits a smaller center-to-center stacking distance between adjacent drapery carriers on a track than heretofore known, thereby permitting a drapery to open more fully than heretofore possible because of the closer stacking of the drapery carriers when the drapery is withdrawn to the sides of a window.

A preferred prior art drapery carrier is shown in FIGS. 14, 19, and 20 of the drawings, for which Taiwanese application 093201271 entitled "Pulley Element of Curtain" was filed by one of the inventors on Jan. 28, 2004, and which was published and issued on Dec. 1, 2004, fully included herein by reference. This prior art drapery carrier is preferred for use with the improved third embodiment carrier strip of the present invention.

Assembly of a plurality of drapery carriers into a drapery track is a labor-intensive task. It is thus desirable to have an improved method of assembly of a plurality of drapery carriers into a drapery track, and a carrier strip for holding the drapery carriers during shipment prior to assembly on a carrier strip, and which facilitates the assembly of the drapery carriers into the drapery track.

None of these prior art references, either singly or in combination, disclose or suggest the present invention.

BRIEF SUMMARY OF THE INVENTION

A first embodiment of the present invention is a drapery carrier comprising a carrier body with first and second coaxially joined wheels on opposite sides of the carrier body, and bearings entrapped within the drapery carrier between raceway seat portions of the wheels. An axial finger extends from the first wheel and is engagingly held within an axial bore of the second wheel. Respective outer circumferential wheel surfaces of the first and second wheels define first and second wheel outer diameters of the first and second wheels, and the bearing center-to-center orbit diameter is less than the first and second wheel outer diameters. Multiple embodiments are disclosed of a carrier strip to hold a plurality of the drapery carriers prior to and during insertion within a drapery track, and these carrier strips permit easy insertion of the drapery carriers into the track by sliding the track onto the drapery carriers while they are held by the carrier strip.

It is an object of the present invention to provide an improved drapery carrier that has a smaller side-to-side dimension than heretofore known in the prior art. It is a further object of the present invention to provide a carrier strip, and method of assembling a plurality of drapery carriers into a drapery track using the carrier strip, that is faster and less labor-intensive than heretofore known in the prior art.

BRIEF DESCRIPTION OF THE SEVERAL VIEWS OF THE DRAWING

FIG. 1 is an exploded perspective parts view of a prior art drapery carrier.

FIG. 2 is a side sectional view of the prior art drapery carrier shown in FIG. 1.

FIG. 3 is an exploded side view of the present invention showing the various parts thereof.

FIG. 4 is a front view of the present invention with the parts assembled.

FIG. 5 is a side sectional view of the present invention taken along the line 5-5 shown in FIG. 4.

FIG. 6 is a bottom view of a carrier strip of the present invention, shown holding one of the drapery carriers of the present invention.

FIG. 7 is a side sectional view of the drapery carrier of the present invention inserted into the carrier strip of the present invention, taken along the line 7-7 shown in FIG. 6, and showing the drapery carrier entrapped within a track.

FIG. 14 is a perspective view of a prior art drapery carrier as disclosed in Taiwanese application 093201271 and which is preferably used with an improved carrier strip of the present invention.

FIG. 15 is a perspective view showing a plurality of prior art drapery carriers held by the improved carrier strip of the present invention during insertion into a drapery track.

FIG. 16 is an end view of a prior art drapery carrier held by the improved carrier strip of the present invention and being inserted into a drapery track.

FIG. 17 is an end view of a prior art drapery carrier held by the improved carrier strip of the present invention.

FIG. 18 is another end view of the prior art drapery carrier, after separation from the improved carrier strip of the present invention.

FIGS. 19 and 20 show additional views of the prior art drapery carrier shown in FIG. 14 and as disclosed in Taiwanese application 093201271.

DETAILED DESCRIPTION OF THE INVENTION

Figure 8:
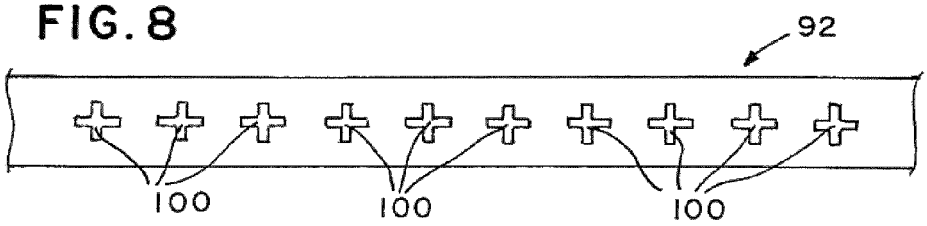
FIG. 8 is a top view of an elongated portion of the carrier strip of the present invention, showing a longer section of the carrier strip than was shown in FIG. 6.

Referring to FIGS. 3-13, drapery carrier 50 is seen to comprise a carrier body 52, first and second wheels 54 and 56, and a plurality of ball bearings 58. Bearings 58 are preferably made of a rust-resistent steel alloy to reduce rust or corrosion in wet or humid areas such as coastal regions, and the remainder of drapery carrier 50 is preferably made of nylon for light weight, strength, and durability. Carrier body 52 has a downwardly-extending pendant portion 60, and carrier body 52 further has an enlarged upper end 62 with an enlarged transverse bore 64 therethrough formed by inner surface 66 of upper end 62.

First wheel 54 has an axial finger 68 extending perpendicularly therefrom and first wheel 54 further has a first raceway seat portion 70 that encircles axial finger 68 and which is engaged by bearings 26. First wheel 54 further has a first outer circumferential wheel surface 72 that defines a first outer wheel diameter 74.

Second wheel 56 has an axial bore 76 therethrough and has a second raceway seat portion 78 encircling axial bore 76 and, like first raceway seat portion 70, second raceway seat portion 78 is engaged by bearings 26. Second wheel 56 further has a second outer circumferential wheel surface 80 that defines a second outer wheel diameter 82. The outer dimensions of first and second wheels 54, 56 are preferably the same so that the drapery carrier sits vertical within the drapery track 84. First and second raceway seat portions 70, 78, and first and second outer circumferential wheel surfaces 72, 80 are preferably made of self-lubricating nylon so as to reduce the friction caused by contact with bearings 58 and track 84, and first and second raceway seat portions 70, 78 are each preferably planar and annulus and perpendicular to the common axis about which first and second wheels 54, 56 rotate with respect to carrier body 52, with first and second wheels 54, 56 being on opposite sides of carrier body 52 with carrier body 52 being entrapped between first and second wheels 54, 56 when axial finger 68 is snapped into axial bore 76 as will now be described.

Axial finger 68 is engagedly held within axial bore 76 and is coaxial therewith, preferably with axial finger 68 having resilient snap engagement members 86, 88 with enlarged tips that compress toward each other when inserted into axial bore 76 and then expand after passing therethrough so as to engagingly snap and hold axial finger 68 within axial bore 76. In contrast to the prior art, axial finger 68 preferably has a solid axis without a longitudinal bore therethrough.

When the carrier 50 is assembled, bearings 58 are entrapped within transverse bore 64 between first and second raceway seat portions 70 and 78, and bearings 58 orbit about axial finger 68 at a bearing center-to-center orbit diameter 90. In contrast to the prior art, bearing orbit diameter 90 is less than first and second wheel outer diameters 74 and 82, which enables the drapery carrier 50 to have a smaller side-to-side dimension than known in the prior art, thereby permitting a smaller center-to-center "stacking distance" of drapery carriers 50 when on a track 84 than shown in the prior art.

To assemble the drapery carriers 50 of the present invention, carrier body 22 is placed horizontally and one of wheels 54, 56 is placed into position on carrier body 52 from the underside and bearings 58 are loaded onto the raceway seat. Preferably second wheel 56 is used as this first placement for loading the bearings because the raised collar 91 about the inner axis of second raceway seat portion 78 acts to hold bearings 58 by within the raceway seat, with bearings 58 resting upon raceway seat portion 78 as first wheel 54 is snapped into position from the top in coaxial alignment with second wheel 56.

There are two preferred embodiments 92, 94 of carrier strips for holding a plurality of drapery carriers 50 prior to and during insertion of the drapery carriers into a track. After these two preferred embodiments 92, 94 have been described, a preferred third improved carrier strip embodiment 130 will be described. The structure of first and second carrier strip embodiments 92, 94 will now be described.

Figure 9:
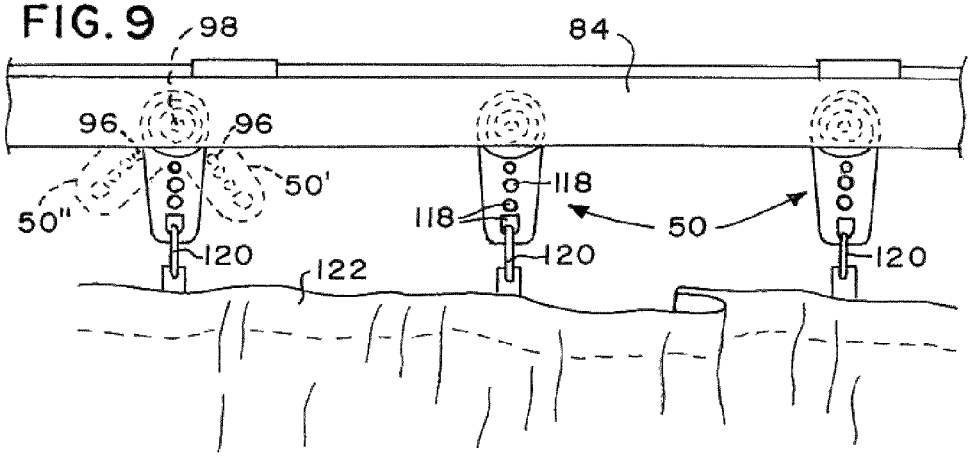
FIG. 9 is a front view of the drapery carrier of the present invention shown holding a drapery on a track.

First embodiment 92 of the carrier strip is shown in FIGS. 6, 7, and 8, and carrier strip 92 is preferably constructed of paper or cardboard. Pendant portion 60 of drapery carrier 50 preferably has at least one lateral post 96 for limiting the angular movement of pendant portion 60 about the axis 98 of first and second wheels 54 and 56 when carrier 50 is mounted within track 84, as best seen in FIG. 9. As pendant portion 60 of carrier 50 moves angularly about axis 98 between position 50' and position 50", the angular movement of pendant portion 60 is limited by the engagement of post 96 with the bottom of track 84 in a manner well-known in the prior art. First embodiment 92 of carrier strip 92 has a plurality of longitudinally aligned spaced apart openings 100 adapted for receipt of pendant portion 60 and post(s) 96. The pendant portions 60 of drapery carriers 50 are inserted into the openings 100 with lateral posts 96 being aligned transverse carrier strip 92, with each drapery carrier's pendant portion and post(s) 96 being within its respective opening 100 of carrier strip 92 and in removable engagement with carrier strip 92 and preferably being frictionally held therewithin. The method of assembling carriers 50 into track 84 using carrier strip 92 will be explained jointly with the method of assembling carriers 50 into track 84 using carrier strip 94, because the two methods have many similarities that differ only because of structural differences between the two carrier strips 92, 94.

Figure 10:
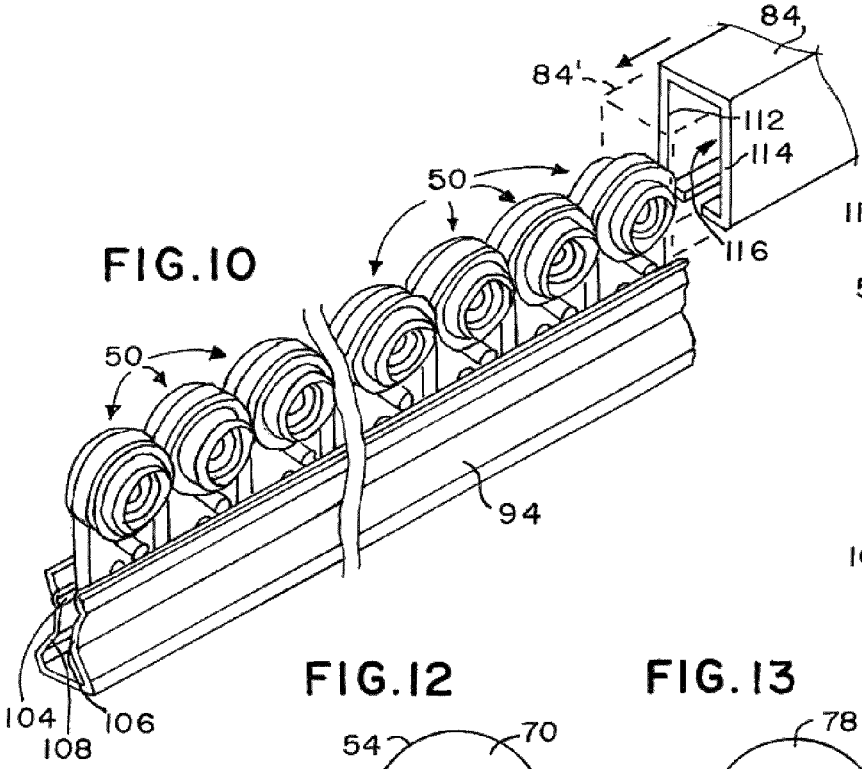
FIG. 10 shows a plurality of the drapery carriers of the present invention held by a second embodiment of the carrier strip of the present invention, and showing the sliding of a track onto the drapery carriers.
Figure 11:
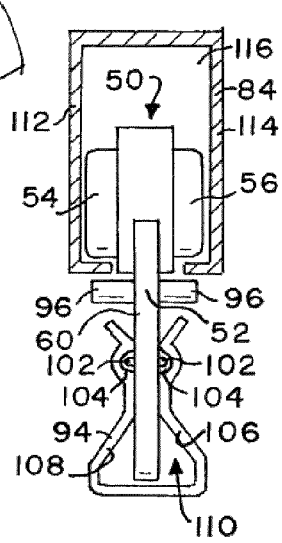
FIG. 11 is a side view of the drapery carrier of the present invention held within the second embodiment of the carrier strip of the present invention, and showing the drapery carrier entrapped within a track.
Figure 12:
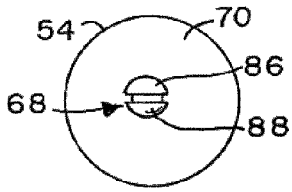
FIG. 12 is a view of the first wheel of the drapery carrier of the present invention, taken along the line 12-12 shown in FIG. 3.
Figure 13:
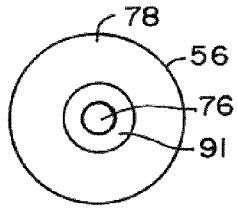
FIG. 13 is a view of the second wheel of the drapery carrier of the present invention, taken along the line 13-13 shown in FIG. 3.

Second embodiment 94 of the carrier strip is shown in FIGS. 10 and 11. For use with this embodiment 94 of the carrier strip, pendant portion 60 has at least one lateral protuberance 102 extending outwardly from pendant portion 60. Preferably protuberance 102 is a ridge as shown for full engagement with recess 104, as hereinafter explained in more detail, but protuberance 102 could simply be a nib, the essential feature being that protuberance 102 engage recess 104 for holding drapery carrier 50 upright within carrier strip 94.

Carrier strip 94 has spaced apart first and second carrier strip sidewalls 106, 108 forming carrier strip channel 110 therebetween, with at least one of first and second carrier strip sidewalls 106, 108 having a recess 104 therewithin and with recess 104 facing carrier strip channel 110 for engagement with protuberance 102. Preferably, carrier strip 94 is extruded from a resilient material such as plastic and has a constant transverse section as best seen in FIG. 11, such that recess 104 is a longitudinal groove for engagement with protuberance 102. While being held by carrier strip 94, the drapery carriers 50 are disposed within carrier strip channel 110 with the axis 98 of rotation of the wheels being aligned transverse to the carrier strip channel and with protuberances 102 being engaged within recess 104.

Common to both embodiments 92, 94 of the carrier strip is that they are held by the carrier strip with the axis of rotation of the wheels being transverse to the carrier strips. Thus held, the strips of drapery carriers may be easily shipped to the installer from the manufacturer.

The use of carrier strips 92, 94 permits practice of the method of the present invention of assembling the plurality of drapery carriers onto track 84. Track 84 is well-known to those skilled in the art, and has opposed track sidewalls 112, 114 forming a track sidewall 116 therebetween. For practice of this method, and while the drapery carriers are held by the carrier strips 92, 94 as heretofore described, track 84 is slid parallel to the carrier strip onto the drapery carriers 50, so as to entrap the first and second wheels 54, 56 within the track channel 116 as shown in dotted outline movement in FIG. 10 as 84'. Then, while the first and second wheels 54, 56 are entrapped within track channel 116 as shown in FIGS. 7 and 11, the carrier strip is removed free of the drapery carriers 50, leaving first and second wheels 54, 56 entrapped within track channel 116. With carrier strip 92, the removal of carrier strip 92 is accomplished by simply pulling carrier strip 92 down and away from the drapery carriers 50 as shown in dotted outline as 92' in FIG. 7. If carrier strip 92 is constructed of paper or cardboard, as preferred, then carrier strip 92 may be torn away from the drapery carriers and discarded. With carrier strip 94, removal can happen in one of two ways. If carrier strip 94 is extruded such that recess 104 is an elongated groove, carrier strip 94 may be slid longitudinally along the line of drapery carriers 50 for removal therefrom. Alternatively, and if desired, if carrier strip 94 is constructed of resilient material, it may simply be pried way from the line of drapery carriers 50, with sidewalls 106, 106 spreading as the carrier strip 94 is pried away from carriers 50 so as to allow protuberances 102 to escape from within recesses 104.

For hanging a drapery 122 upon the drapery carriers 50 at a variety of heights, carriers 50 are provided with a plurality of transverse holes 118 into which a well-known drapery hook 120 may be inserted as desired between the drapery and the drapery carrier 50.

Turning to FIGS. 14-20, an improved third embodiment 130 of the carrier strip will now be disclosed and described in detail, together with the prior art drapery carrier 2.50 that is preferably used with carrier strip 130. There are many similarities between improved carrier strip 130 and the earlier embodiments, previously described, so only the differences will be described in detail.

FIGS. 14, 18, and 19 show a prior art drapery carrier 2.50 for which Taiwanese application 093201271 entitled "Pulley Element of Curtain" was filed by one of the inventors on Jan. 28, 2004, and which was published and issued on Dec. 1, 2004 (hereinafter, "Kao"), fully included herein by reference. Drapery carrier 2.50, with modified wheels as described hereinbelow, is a preferred drapery carrier for use with the improved third embodiment 130 of the carrier strip of the present invention. Like other drapery carriers, drapery carrier 2.50 has a carrier body 2.52 with a downwardly-extending pendant portion 2.60 upon which a drape may be hung in a manner well-known to those skilled in the art and as shown, for example, in Kao, as by snapping a pendant attachment 2.200 into the receiving slot 2.61 in the lower portion 2.59 of pendant portion 2.60 as by receiving neck 2.202 of snappiece 2.203 into slot 2.61. As shown in FIG. 20, pendant attachment 2.200 has a hole 2.204 with a bevel 2.205 that receives a snap 2.206 of a drape 2.207 so that drape 2.207 is held to pendant attachment 2.200. Drapery carrier 2.50 has first and second wheels 2.54, 2.56 that are joined by a metal axial brad 2.68. Drapery carrier 2.50 has a freely rotating cap 2.63 that rotates about a vertical axis with a cord 2.65 being similarly threaded through caps 2.63 of all carriers 2.50 as by through a transverse hole 2.67 through cap 2.63. Other than axial brad 2.68, all parts of drapery carrier 2.50 and pendant attachment 2.200 are typically made of a plastic such as nylon for light weight, durability and strength.

Table 1, below, shows the center-to-center spacing of the drapery carriers, changed by selecting an appropriate length of cord 2.65 between the drapery carriers, to achieve a desired "drapery fullness" value when the drapery carriers are inserted into a drapery track with a drapery hung from the drapery carriers:

TABLE 1

Center-to-Center Spacing vs. Fullness Value

| Fullness Value | Center-to-Center Spacing |
|---|---|
| 60% | 2.625 in. (6.6675 cm.) |
| 80% | 2.375 in. (6.0325 cm.) |
| 100% | 2.125 in. (5.3975 cm.) |
| 120% | 1.875 in. (4.7625 cm.) |

Well-known drapery track 2.84 is typically extruded from a metal such as aluminum, and has a generally rectangular inner channel 2.116 for receiving the wheels and body of drapery carrier 2.50. It has been found that rounding the outer edges 2.55, 2.57 of wheels 2.54 and 2.56, as seen best in FIGS. 16-18, allows wheels 2.54 and 2.56 to enter the drapery track 2.84 more easily, thereby reducing the difficulty of assembling the drapery carriers 2.50 into track 2.84, so the preferred modification of rounding the edges of wheels 2.54, 2.56 has been made to the prior art carrier 2.50 as shown in FIGS. 14, 19, and 20 for use with the improved carrier strip 130 of the present invention.

Lower portion 2.59 of carrier 2.50 has left and right lateral flanges 2.102 that extend horizontally outwardly from carrier 2.50.

The improved carrier strip 130 has a substantially constant transverse profile, as seen in FIGS. 15-18, made of a resilient material such as plastic, and has a base 132 with left and right sidewalls 134, 136 extending upwardly therefrom, forming a carrier strip channel 138 therebetween for receiving the lower portion 2.59 of carrier 2.50. Specifically, left and right sidewalls 134, 136 each have a recess 104 formed therewithin for respectively receiving the left and right lateral flanges 2.102 of carrier 2.50. The resilience of carrier strip 130 biases sidewalls 134, 136 inwardly for holding the carriers 2.50 as seen best in FIGS. 16 and 17, with upper edges 142, 144 of sidewalls 134, 136 preferably pointing inwardly so as to retain flanges 2.102.

As seen in FIG. 15, a plurality of carrier strips 130 are preferably provided. The improvement of the present invention, by providing a plurality of carrier strips 130, allows a large group of drapery carriers 2.50 to be shipped, assembled on the plurality of carrier strips 130, in a compact package that can be readily shipped using common shipping carriers, with the carriers 2.50 being apportioned between the plurality of carrier strips 130 within the package. Carriers 2.50 are typically received from the manufacturer in rolls of 500, and have a width, as measured along cord 2.65, of 0.625 inches (1.5875 cm.). Because a package of up to about ten feet (3.048 meters) can be easily shipped, this allows about 192 or so carriers 2.50 to be held in a ten foot (3.048 meters) carrier strip 130. If smaller packages are desired, then shorter carrier strips 130 may be used, carrying 37 or more carriers 2.50. The carrier strips 130, with carriers 2.50 held therein, are then closely packed into a package for shipment, with the cord 2.65 between end carriers 2.50*a* and 2.50*b* of adjacent carrier strips 130 connecting the carriers on one carrier strip to those on the next in the sequence, as seen best in FIG. 15. This structure permits carriers 2.50 to be shipped more compactly in a package than heretofore possible while assembled on a carrier strip, ready for insertion into the track 2.84.

For practice of the method using the improved carrier strip 130, and with the drapery carriers 2.50 being apportioned between and held by the plurality of carrier strips 130 as heretofore described and as seen in FIG. 15, track 2.84 is slid parallel to the first carrier strip 130 onto the drapery carriers 2.50, as best seen in FIGS. 15 and 16, and in a manner similar to that hereinbefore described with carrier strip 94, so as to entrap the first and second wheels 2.54, 2.56 within the track channel 2.116 as shown in FIGS. 15 and 16. Then, while the first and second wheels 54, 56 are entrapped within track channel 2.116 as shown in FIG. 16, the first carrier strip 130 is removed free of the drapery carriers 2.50, leaving first and second wheels 2.54, 2.56 entrapped within track channel 2.116. With carrier strip 130, the removal of carrier strip 130 is accomplished by simply sliding carrier strip 130 parallel to drapery track 2.84 while at least one of the drapery carriers 2.50, entrapped within track channel 2.116, is also disposed within the carrier strip channel 2.138 of the first carrier strip 130, or else, because of the resilience of carrier strip 130, by pulling the first carrier strip 130 down and away from the drapery carriers 2.50 as previously described for other embodiments of the carrier strip. An installer's fingers F and thumb T easily grip the outsides of sidewalls 134, 136 of carrier strip 130 during assembly of the carriers 2.50 into track 2.84 as shown in dotted outline in FIG. 16. The process is then repeated for the next of the carrier strips 130 in the sequence of carriers 2.50 along cord 2.65, until all of the desired carriers 2.50 have been assembled onto the track 2.84. In this manner, a track 2.84 can be loaded with drapery carriers 2.50 faster than heretofore known in the prior art.

Although the present invention has been described and illustrated with respect to a preferred embodiment and a preferred use therefor, it is not to be so limited since modifications and changes can be made therein which are within the full intended scope of the invention.

We claim:

1. A plurality of drapery carriers held within a plurality of carrier strips for engagement with a track, each said drapery carrier comprising:

(a) a carrier body having a downwardly-extending pendant portion, said pendant portion having left and right lateral flanges extending outwardly therefrom;

(b) a first wheel and a second wheel, said first and second wheels being on opposite sides of said carrier body and being mounted to said carrier body for rotation with respect thereto about an axis;

each said drapery carrier of said plurality of drapery carriers being joined to an adjacent drapery carrier of said plurality of drapery carriers by a cord;

wherein the improvement comprises said plurality of said carrier strips, each said carrier strip having spaced apart first and second opposed carrier strip sidewalls forming a carrier strip channel therebetween, each of said first and second carrier strip sidewalls having a recess therewithin and facing said carrier strip channel, each said carrier strip channel extending longitudinally along its said carrier strip from at least a first end of its said carrier strip, each said recess of said first and second carrier strip sidewalls also extending longitudinally along its said carrier strip;

with said drapery carriers being apportioned between said plurality of carrier strips and disposed within said carrier strip channels of said plurality of carrier strips and longitudinally slideable when said pendant portion is fully inserted into its said carrier strip channel, with said left and right lateral flanges slideably engaged in said recesses during sliding movement of said drapery carriers within its said carrier strip channel parallel to its said carrier strip channel longitudinal direction with said axis of each said drapery carrier being aligned transverse its respective said carrier strip channel longitudinal direction and with said lateral flanges of said drapery carriers being engaged in said recesses, said cord joins drapery carriers held within one carrier strip of said plurality of carrier strips to drapery carriers held within another of said plurality of carrier strips.

2. The drapery carriers and improvement as recited in claim 1, in which said carrier strips are mutually parallel and adjacent one another for shipment in a package.

3. A method of assembling the plurality of drapery carriers held within said plurality of said carrier strips as recited in claim 1 onto a track, said method comprising the steps of:

(a) providing said track, said track having opposed track sidewalls forming a track channel therebetween;

(b) providing said plurality of drapery carriers held within said plurality of said carrier strips;

(c) while said some of said drapery carriers are disposed within a respective apportioned one of said carrier strip channels of said plurality of carrier strips, sliding said track onto said some of said drapery carriers so as to entrap said first and second wheels of said drapery carriers within said track channel; and then (d) while said first and second wheels of said some of said drapery carriers are entrapped within said track channel, removing said apportioned one of said carrier strips free of said some of said drapery carriers by sliding said apportioned one of said carrier strips substantially parallel to said track channel, while at least one of said some of said drapery carriers remains disposed within said apportioned one of said carrier strip channels, and leaving said first and second wheels of said some of said drapery carriers entrapped within said track channel.

* * * * *